US005183361A

United States Patent [19]

Ho

[11] Patent Number: 5,183,361

[45] Date of Patent: Feb. 2, 1993

[54] PUNCHING AND BINDING MACHINE

[76] Inventor: Jackson Ho, 1st Fl., 17, Lane 10, Chung Shan Rd., Panchiao City, Taiwan

[21] Appl. No.: 786,939

[22] Filed: Nov. 4, 1991

[51] Int. Cl.[5] ..... B42B 5/10

[52] U.S. Cl. ..... 412/16; 412/40

[58] Field of Search ..... 412/16, 20, 40

[56] References Cited

U.S. PATENT DOCUMENTS

| | | | |
|---|---|---|---|
| 3,122,761 | 3/1964 | Bouvier | 412/40 |
| 3,699,596 | 10/1972 | Lyon | 412/40 X |
| 3,866,254 | 2/1975 | Gronda | 412/40 |
| 3,967,336 | 7/1976 | Cutter | 412/40 X |
| 4,008,501 | 2/1977 | Cutter | 412/40 X |
| 4,645,399 | 2/1987 | Scharer | 412/16 |
| 4,872,796 | 10/1989 | Hsieh et al. | 412/16 |
| 5,059,078 | 10/1991 | Schmid | 412/40 X |

*Primary Examiner*—Paul A. Bell

*Attorney, Agent, or Firm*—Bacon & Thomas

[57] ABSTRACT

A punching and binding machine comprises a punching mechanism and a binding mechanism located in the front and rear part of a body. The punching mechanism includes a plurality of punchers which can be driven to travel transversely to punch paper placed on a paper holder. Beneath the paper holder there is a support element incorporated with an eccentric rod for adjustment of distance between position to be punched and edge of paper. The binding mechanism makes use of a sliding board and a shifter holder to open clipping element of a binding ring placed on a fixing plate on its upper casing by a shifter for binding of the papers. It has a sliding board sliding in the sliding slots on the left and right body elements, and a stopping element to adjust sliding interval in order to control the size of clipping element opening opened by the shifter for binding with binding ring of different diameter.

5 Claims, 5 Drawing Sheets

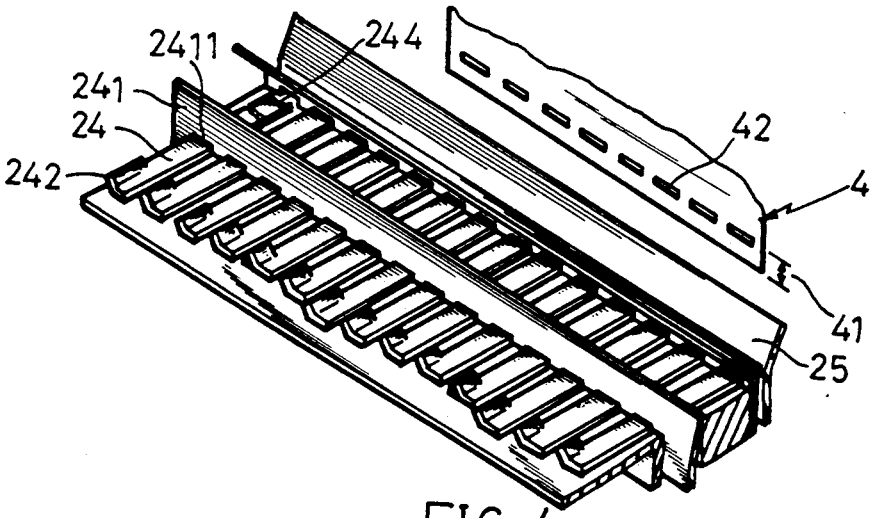
FIG.4
FIG.5
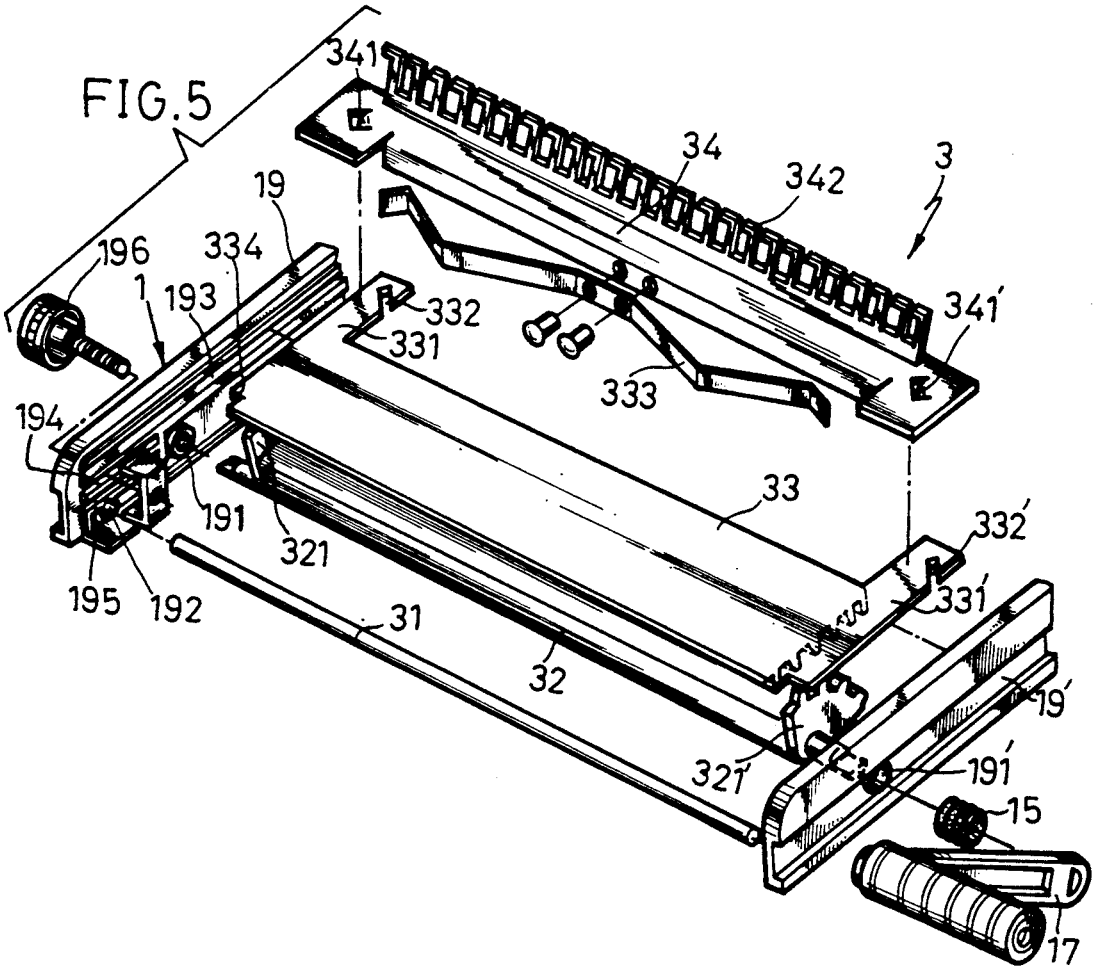

PUNCHING AND BINDING MACHINE

BACKGROUND OF THE INVENTION

The present invention relates to a punching and binding machine, particularly a machine to punch papers and bind such papers with binding rings.

Conventionally papers are punched by a puncher and then bound by a binder in any form such as the latest binding ring. The present invention provides a punching and binding machine which has the follow features:

(1) A punching mechanism and a binding mechanism located on the front and rear parts of a body respectively are designed for punching and binding at high speed.

(2) Puncher control lever is designed behind each puncher and can be retained by a rubber strip as a control on interval and number of holes.

(3) A drawer is designed on the back of the body to collect paper scraps after punching, and a knob is designed on a side of the body to control distance between position to be punched and edge of paper.

(4) Punchers of different lengths are used for punching in a sequence to minimize power required for punching.

(5) A stopping element is designed at a side of the binding mechanism to adjust displacement of a movable sliding board, and consequently control the distance of a clipping element opened by shifter on the sliding board in order to fit using of binding ring of different diameter without restriction on quantity of papers to be bound, and permit addition or removal of papers after binding.

SUMMARY OF THE INVENTION

The present invention provides a punching and binding machine, particularly a machine to punch, and bind paper with binding ring at high speed.

The present invention accordingly comprises a punching mechanism and a binding mechanism located in the front and rear part of a body. The punching mechanism includes a plurality of punchers which can be driven to travel transversely to punch paper placed on a paper holder. Beneath the paper holder there is a support element incorporated with an eccentric rod for adjustment of distance between position to be punched and edge of paper. The binding mechanism makes use of a sliding board and a shifter holder to open clipping element of a binding ring placed on a fixing plate on its upper casing by a shifter for binding of the papers. It has a sliding board sliding in the sliding slots on the left and right body elements, and a stopping element to adjust sliding interval in order to control the size of clipping element opening opened by the shifter for binding with binding ring of different diameter.

BRIEF DESCRIPTION OF THE DRAWINGS

FIG. 4 illustrates structure of the punchers according to the present invention.

FIG. 5 is a fragmental view of the binding mechanism according to the present invention.

DETAILED DESCRIPTION OF THE PREFERRED EMBODIMENT

Figure 1:
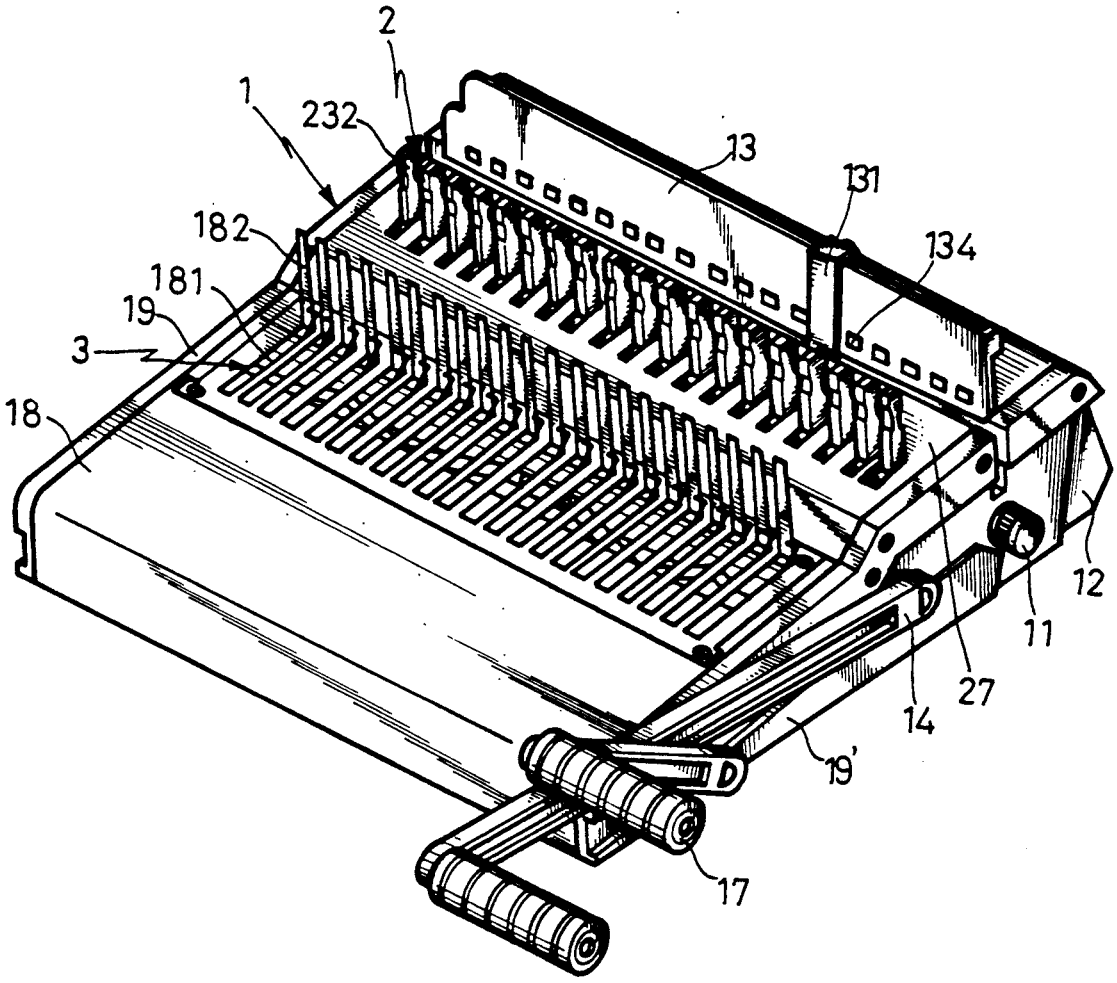
FIG. 1 is a perspective view of a punching and binding machine according to the present invention.
Figure 2:
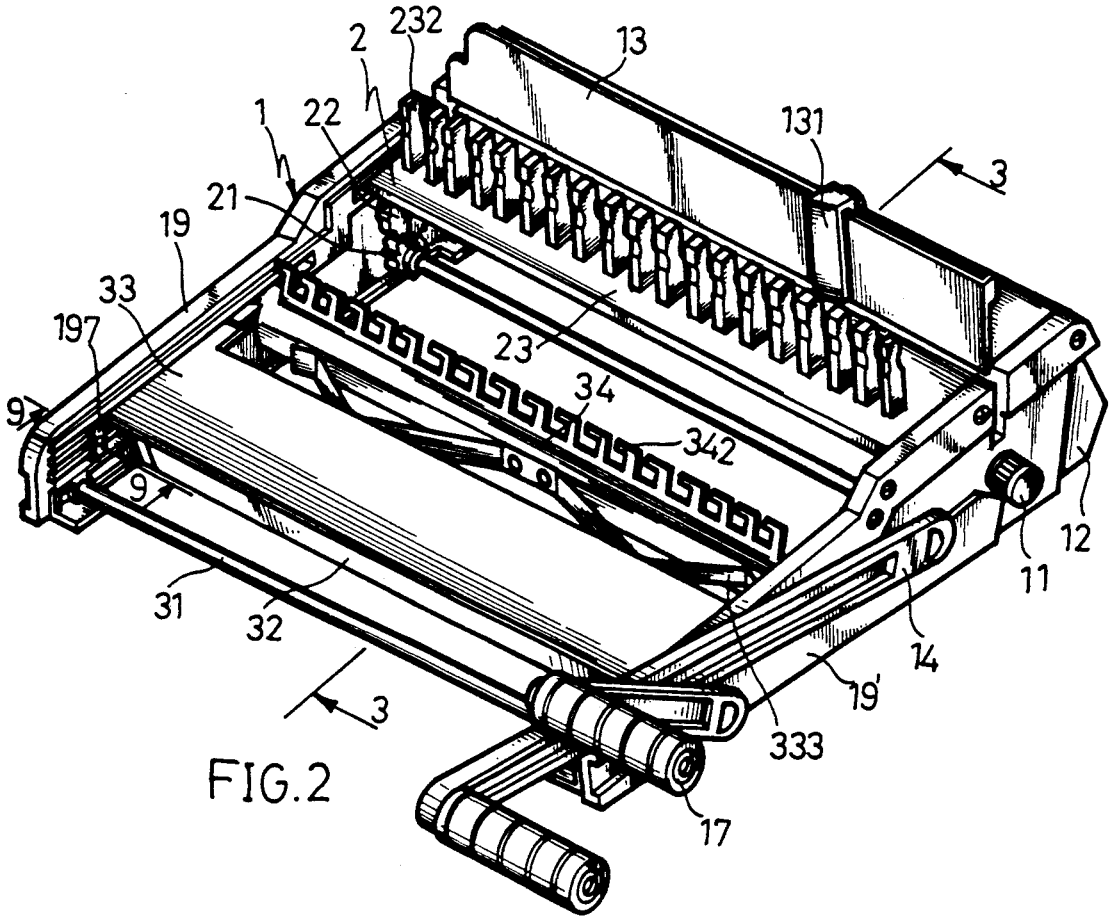
FIG. 2 is a perspective view illustrating assembly of the punching and binding machine according to the present invention.
Figure 3:
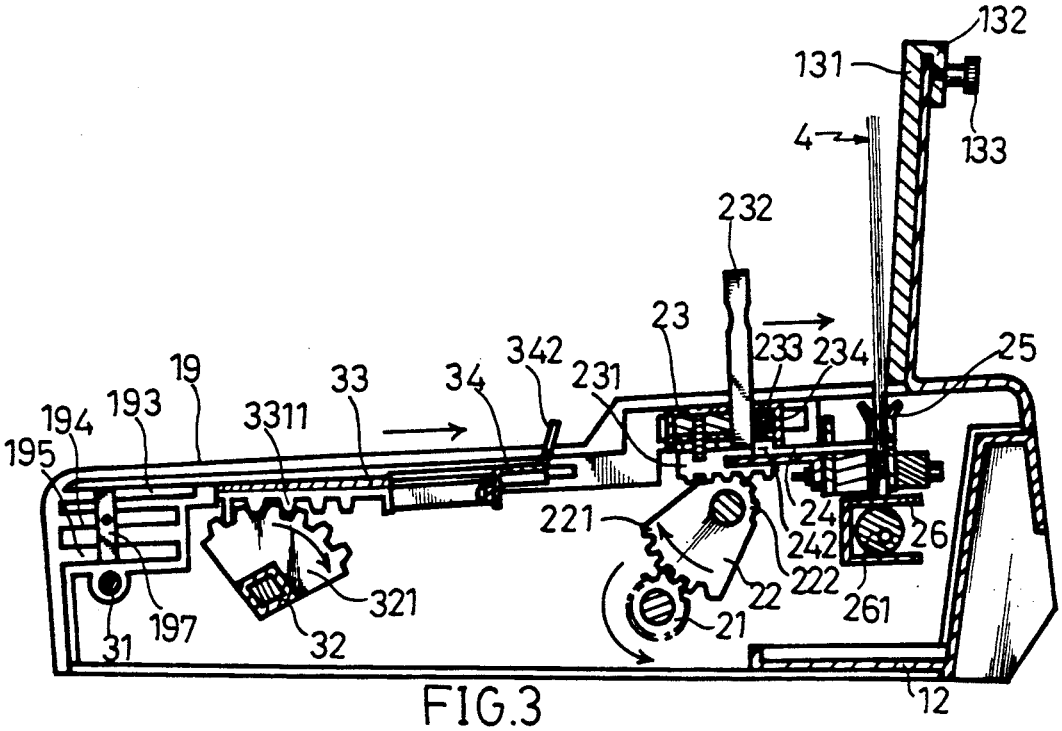
FIG. 3 is a sectional view taken along the line 3—3 in FIG. 1.

As shown in FIG. 1, the punching and binding machine according to the present invention comprises a punching mechanism (2) located on the rear end of a body (1) and a binding mechanism (3) on the front end of the body (1). As shown in FIGS. 2, 3, and 4, the punching mechanism (2) has two linking gears (21), one at each lateral side below the rear end of the body (1) and engaging with a lower gear (221) below a control cam (22). An upper gear (222) is located above the control cam (22) for engaging with a rack (231) beneath a feeder block (23). There is a plurality of puncher control levers (232) on the feeder block (23) to push a plurality of punchers (24) to slide rightwards in order to punch papers (4). Any of these control levers (232) can be pulled up and retained elastically by a rubber strip (233) in the feeder block (23) so that such control lever (232) will not fall down and push the corresponding puncher (24) to punch. Hence, the number of holes to be punched can be controlled—the first feature of the present invention.

As shown in FIGS. 3 and 4, the punchers (24) are arranged in parallel, and each of them is positioned in a slot (2411) below a fixing plate (241). Each puncher (24) has a bent portion (242) at a side of its rear end, and an arched cutter (244) at its front end. After completion of each punching, the bent portion (242) is seized by a bracket (234) at the front end of the feeder block (23) so that the puncher (24) can return to its original position following the return of the feeder block (23). The punchers (24) are designed in different lengths so that they are fed individually to minimize force required for punching, and consequently the punching requires minimum driving force—the second feature of the present invention.

As shown in FIG. 3, papers (4) are placed in a paper holder (25) at the back of the punchers (24). A support element (26) with an eccentric rod (261) in it is located beneath the paper holder (25). As shown in FIGS. 1, 3 and 4, the body (1) has a knob (11) at the right side to connect to the eccentric shaft (261). By rotation of the knob (11), the eccentric rod (261) is turned to displace the support element (26) upwards or downwards, and consequently the distance between binding hole (42) to be punched and edge of papers (4) can be controlled—the third feature of the present invention. A drawer (12) is designed below the paper holder (25) in the body (1) to collect paper scraps from the punching, and a stop plate (13) is extended from the back of the body (1). A movable adjusting board (131) is located above the stop plate (13), and a seat portion (132) formed on the back of the adjusting board (131) and movably fixed on the stop plate (13) by means of a fixing bolt (133). The adjusting board (131) can be set corresponding to punching marks (134) beneath the stop plate (13) for control and alignment of punching position.

As shown in FIG. 2, the linking gear (21) is connecting to a pull lever (14) at the right side of the body (1). The pull lever (14) is designed to control the punching mechanism for feeding of the punchers by forward pulling and returning of the punchers by backward pulling. The punching mechanism (2) is covered by an upper hood (27).

As shown in FIGS. 1 and 5, the punching mechanism (3) is located at the front side of the body (1), and covered by an upper casing (18).

The upper casing (18) has a plurality of long slots (181) at appropriate positions on its rear upper surface, and a plurality of fixing plates (182) extending upwards from its front end. The body (1) is composed of a left body element (19) and a right body element (19'). There are two fixing holes (191 and 191') at the inner wall of the left body element (19) for installation of a support rod (31) and a transmission shaft (32) between the left body element (19) and the right body element (19'). Each end of the transmission shaft (32) is incorporated with a sector gear (321 or 321'), and an end of the transmission shaft (32) is extending to a fixing hole (191') at the right body element (19') where a control handle (17) is connected. A sliding board (33) is designed between the left and right body elements (19 and 19'). The sliding board (33) has a positioning element (331) at one end and another positioning element (331') at another end so that the sliding board (33) can be slid within two symmetric sliding slots (193 and 193', 193' is not shown in the drawing) on the left and right body elements (19 and 19'). Each positioning element (331 or 331') has a rack (3311 or 3311') beneath it to engage with a sector gear (321 or 321') of the transmission shaft (32). Then, by forward or backward swinging of the control lever (17), the sliding board (33) can be slid and displaced forwards or backwards. The right end of the transmission shaft (32) passes through the fixing hole (191) on the right body element (19), and is incorporated with a rubber ring (15) there as a stop for the pull lever (14) in order to prevent from injury to operator's hand from falling down of the pull lever (14) during punching operation.

Figure 6:
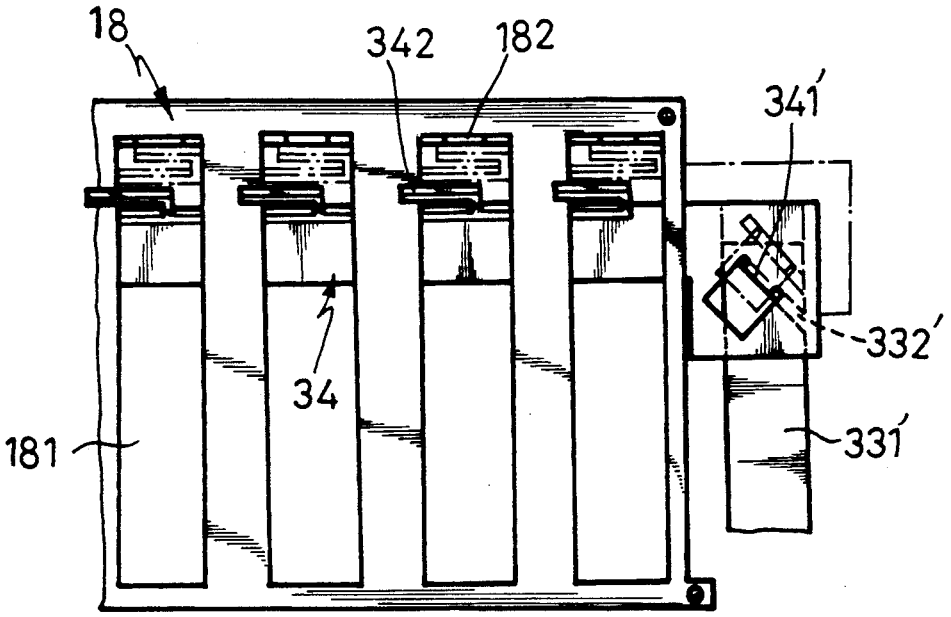
FIG. 6 illustrates action of the shifter holder according to the present invention.
Figure 7:
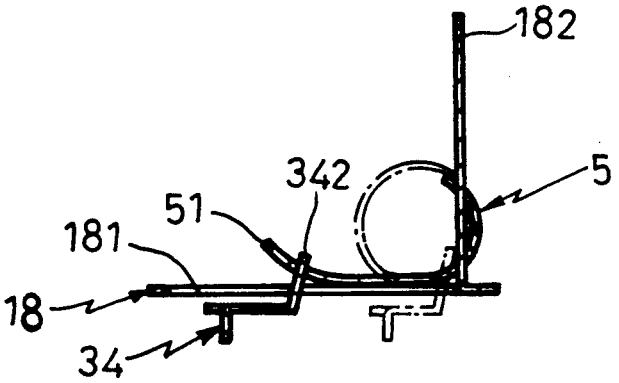
FIG. 7 illustrates action of the shifter in opening of the clipping element (I).
Figure 8:
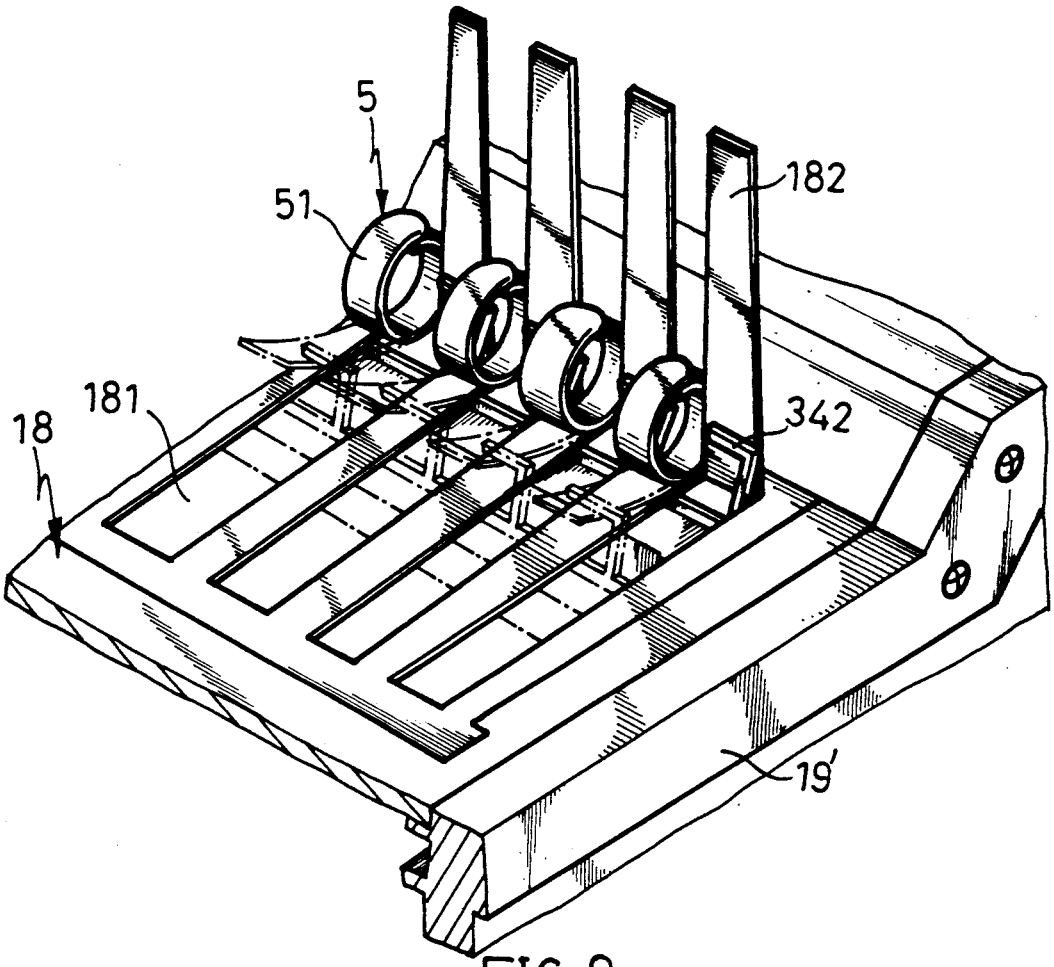
FIG. 8 illustrates action of the shifter in opening of the clipping element (II)
Figure 9:
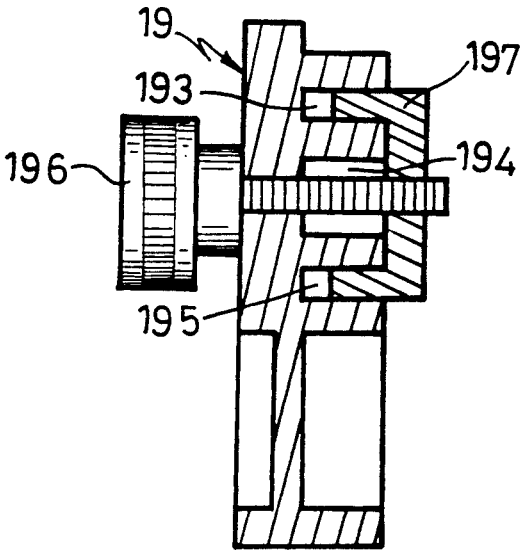
FIG. 9 is a sectional view taken along the line 9—9 in FIG. 2.

As shown in FIG. 5, each of the positioning elements (331 or 331') of the sliding board (33) has a oblique slot (332 or 332') at the front end for holding of a tab (341 or 341') extended from an end of a shifter holder (34). A bent spring plate (333) is placed between the shifter holder (34) and the sliding board (33) so that the shifter holder (34) keeps contact with the two positioning elements (331 and 331') of the sliding board (33) by tension of the bent spring plate (333). On the shifter holder (34) there is a plurality of L-like shifters (342). As shown in FIG. 6, the positioning element (331') of the sliding board (33) can displace upwards to push the shifters (342) and then displace rightwards for its tab (341) is located in the oblique slots (332') so that it is aligned with the fixing plate (182) of the upper casing (18), and consequently a binding ring (5) can be placed on the fixing plate (182). As shown in FIGS. 5, 7 and 8, by backward pulling of the control lever (17), the sliding board (33) and the shifter holder (34) are displaced backwards, the shifter (343) is consequently displaced backwards to open a clipping element (51) of each binding ring (5) for binding of the punched papers with the binding rings to complete the binding process. Its process is the fifth feature of the present invention. The bent spring plate (333) between the shifter holder (34) and the sliding board (33) also provides a tension to return the shifter holder (34) to its original position after the rightward displacement.

As shown in FIGS. 3. 5 and 9, the present invention has a stopping notch (334) at the left end of the sliding board (33), a passing slot (194) and a positioning slot (195) in order below a sliding slot (193) on the inner wall surface of the left body element (19), a stopper element (197) inserted to the passing slot (194') and fixed thereto by means of a round head bolt (196) so as the stopper element (197) can be slid forwards or backwards in the slots (193 and 195). Then, by different displacement of the stopper element (197), the opening of the clipping element (51) of the binding ring (5) opened by the shifter (342) can be controlled for use of binding ring of different diameter in binding of papers.

I claim:

1. A punching and binding machine to punch papers by transverse feeding of punchers and then bind such papers with a binding ring, comprising a body composed of a left body element and a right body element, having a knob, a pull lever and a control lever at their appropriate positions on a side of the right body element, a stop plate extended upwards from the back of the body, a movable adjusting board mounting on the stop plate, a seat portion formed on the back of the adjusting board and movably fixed on the stop plate by means of a fixing bolt, and a plurality of punching marks located beneath the stop plate for aligning of papers;

a punching mechanism located in the rear part of the body, incorporated with a linking gear on the body and engaging with a lower gear below a control cam in connection with an upper gear for engaging with a rack beneath a feeder block with a plurality of vertical puncher control levers to push a plurality of punchers arranged in parallel, each positioned in a slot below a fixing plate, having a bent portion at a side of its rear end and an arched cutter at its front end, and having a paper holder in front of the punchers incorporated with a support element having an eccentric rod in it so that by rotation of the knob, the distance between the position to be punched and the edge of papers can be controlled, and a upper cover to cover the punching mechanism;

a binding mechanism having a sliding slot and two fixing holes on the left body element, and a sliding slot and two fixing holes on the right body element for installation of a sliding board, a support rod and a transmission shaft, in which the sliding board has a positioning element at one end and another positioning element at another end, each of the positioning elements has an oblique slot at the front end for holding of a tab extended from an end of the shifter holder, and to position the positioning elements in the sliding slots on the left and right body elements, a rack is located at the lower end of each positioning element to engage with a sector gear at each end of the transmission shaft which is extended to outside of the right body element to connect a control lever, the shifter holder has a plurality of L-like shifters, a passing slot and positioning slot are designed below the sliding slot of the left body element for fixing of a stopper element by means of a round head bolt in order to permit the stopper element to slide forwards or backwards in the passing slot and the sliding slot, and an upper casing is used to cover the binding mechanism with a plurality of long slots at appropriate positions for passing of the shifters, and a fixing plate extended vertically upwards from the back end of each long slot for holding of a binding ring.

2. A punching and binding machine as claimed in claim 1 wherein there is a plurality of puncher control levers on the feeder block to push a plurality of punchers to slide rightwards in order to punch papers and each control lever can be pulled up and retained elastically by a rubber strip in the feeder block so that such control lever will not fall down and push the corresponding puncher to punch, and hence the number of holes to be punched can be controlled.

3. A punching and binding machine as claimed in claim 1 wherein the punchers are of different lengths and pushed by puncher control levers individually for punching in a sequence to minimize power required for punching.

4. A punching and binding machine as claimed in claim 1 wherein the movable board and shifter holder in the binding mechanism has oblique slots and tabs so that the shifters can be slid rightwards following displacement of the shifter holder, and the movable board and shifter holder has posts and springs to provide the shifter holder with tension to resume its original position after the rightward displacement.

5. A punching and binding machine as claimed in claim 1 wherein the sliding board has a stopping notch at the left end to stop displacement of the stopper element secured to the sliding board by means of round head bolt in order to control displacement of the stopper element and consequently the opening of clipping element of a binding ring opened by the shifter can be controlled.

* * * * *